US008659479B2

(12) United States Patent
Tsai et al.

(10) Patent No.: US 8,659,479 B2
(45) Date of Patent: Feb. 25, 2014

(54) DUAL-BAND ANTENNA AND ANTENNA DEVICE HAVING THE SAME

(75) Inventors: Tiao-Hsing Tsai, Yunghe (TW); Chieh-Ping Chiu, Yunlin County (TW); Feng-Jen Weng, Tao Yuan Shien (TW); I-Ping Yen, Yonghe (TW)

(73) Assignee: Quanta Computer, Inc., Tao Yuan Shien (TW)

( * ) Notice: Subject to any disclaimer, the term of this patent is extended or adjusted under 35 U.S.C. 154(b) by 879 days.

(21) Appl. No.: 12/709,830

(22) Filed: Feb. 22, 2010

(65) Prior Publication Data

US 2011/0084882 A1 Apr. 14, 2011

(30) Foreign Application Priority Data

Oct. 8, 2009 (TW) ..... 98134111 A

(51) Int. Cl.
*H01Q 1/38* (2006.01)

(52) U.S. Cl.
USPC ..... 343/700 MS; 343/702; 343/872

(58) Field of Classification Search
USPC ..... 343/700 MS, 702, 872
See application file for complete search history.

(56) References Cited

U.S. PATENT DOCUMENTS 6,950,065 B2 * 9/2005 Ying et al. ..... 343/700 MS
2006/0099914 A1 * 5/2006 Andersson ..... 455/90.3
2007/0139270 A1 * 6/2007 Takei et al. ..... 343/700 MS
2007/0182636 A1 * 8/2007 Carlson ..... 343/700 MS
2009/0021448 A1 * 1/2009 Tsai et al. ..... 343/893

FOREIGN PATENT DOCUMENTS

CN 1409570 A 4/2003
CN 101043101 A 9/2007
CN 201167131 Y 12/2008
CN 201207428 Y 3/2009
EP 1361623 A1 11/2003

OTHER PUBLICATIONS

English translation of Search Report appended in an Office Action dated Dec. 4, 2012, issued to Chinese Counterpart Patent Application No. 200910205372.7, 2 pages.

* cited by examiner

*Primary Examiner* — Dameon Levi
*Assistant Examiner* — Collin Dawkins
(74) *Attorney, Agent, or Firm* — Berenato & White, LLC

(57) ABSTRACT

A dual-band antenna includes first and second connecting sections coupled to a ground unit, and first, second, and third radiator sections. The first connecting section extends in a direction from the ground unit toward an inner wall face of a housing of an electronic device. The first radiator section is connected to the first connecting section and is disposed to extend along the inner wall face. A feed-in section extends between the second connecting section and the inner wall face, and has a portion extending parallel to the first radiator section. The second radiator section is connected to the feed-in section and is disposed to extend along the inner wall face. The third radiator section is connected to the second radiator section, extends between the second radiator section and the feed-in section, and has a portion extending parallel to the second radiator section.

9 Claims, 8 Drawing Sheets

DUAL-BAND ANTENNA AND ANTENNA DEVICE HAVING THE SAME

CROSS-REFERENCE TO RELATED APPLICATION

This application claims priority of Taiwanese Application No. 098134111, filed on Oct. 8, 2009.

BACKGROUND OF THE INVENTION

1. Field of the Invention

The present invention relates to an antenna, more particularly to a dual-band antenna.

2. Description of the Related Art

Currently, there are many different wireless telecommunication technologies. Depending on the coverage, the technologies can be categorized into different categories of network. A network employing a technology that provides city-to-city or even country-to-country coverage is referred to as a Wireless Wide Area Network (WWAN), which typically operates at frequencies ranging from 824 MHz to 960 MHz and from 1710 MHz to 2170 MHz. A network employing a technology that provides a coverage with a radius of approximately 100 meters from an access point to a subscriber is referred to as a Wireless Local Area Network (WLAN), which typically operates at frequencies ranging from 2412 MHz to 2462 MHz (820.11b/g) and 4900 MHz to 5875 MHz (802.11a).

Referring to FIG. 1, portable computers (e.g., laptop computers, notebook computers, network computers) and handheld devices are generally provided with a conventional planar inverted-F antenna 9 for access to a WWAN. Nevertheless, the planar inverted-F antenna 9 is known to have a narrow bandwidth, low efficiency, and a directional antenna radiation pattern.

SUMMARY OF THE INVENTION

Therefore, an object of the present invention is to provide a dual-band antenna that occupies relatively small space and that has a relatively high radiation efficiency.

Accordingly, a dual-band antenna of the present invention is adapted to be disposed in a housing of an electronic device. The dual-band antenna includes a ground unit for grounding, a first radiator arm, and a second radiator arm.

The first radiator arm includes a first connecting section and a first radiator section. The first connecting section is coupled to the ground unit and extends in a direction from the ground unit toward an inner wall face of the housing when the dual-band antenna is disposed in the housing. The first radiator section is connected to the first connecting section and is disposed to extend along the inner wall face of the housing when the dual-band antenna is disposed in the housing.

The second radiator arm includes a second connecting section, a feed-in section for signal feed-in, a second radiator section, and a third radiator section. The second connecting section is coupled to the ground unit. The feed-in section extends between the second connecting section and the inner wall face of the housing when the dual-band antenna is disposed in the housing. The feed-in section has a portion extending parallel to the first radiator section. The second radiator section is connected to the feed-in section and is disposed to extend along the inner wall face of the housing when the dual-band antenna is disposed in the housing. The third radiator section is connected to the second radiator section and extends between the second radiator section and the feed-in section. The third radiator section has a first portion extending parallel to the second radiator section.

Preferably, the ground unit includes first and second ground parts for connecting electrically to an electrical ground of the electronic device. The first and second ground parts are spaced apart from each other. The first ground part is connected to the first connecting section of the first radiator arm. The second ground part is connected to the second connecting section of the second radiator arm.

Preferably, the first connecting section has a first end connected to the first ground part, and a second end opposite to the first end. The first radiator section extends in a direction from the second end of the first connecting section toward the second radiator section, and is substantially perpendicular to the first connecting section.

Preferably, the feed-in section has a feed-in portion adjacent to the first connecting section for signal feed-in. The second connecting section interconnects the second ground part and the feed-in portion. The second radiator section has a first end proximate to the first radiator section. The feed-in section is connected to the first end of the second radiator section.

Preferably, the second radiator section further has a second end opposite to the first end. The third radiator section further has a second portion interconnecting the first portion of the third radiator section and the second end of the second radiator section. The first portion of the third radiator section extends in a direction from the second portion of the third radiator section toward the first connecting section.

Another object of the present invention is to provide an antenna device that occupies relatively small space and that has a relatively high radiation efficiency.

Accordingly, an antenna device of the present invention includes a substrate, a ground unit for grounding, a first radiator arm, and a second radiator arm.

The substrate has opposite first and second surfaces, and opposite first and second peripheral edges. The ground unit is disposed at the first peripheral edge of the substrate.

The first radiator arm includes a first connecting section and a first radiator section. The first connecting section is disposed on the second surface of the substrate, is coupled to the ground unit, and extends in a direction from the ground unit toward the second peripheral edge of the substrate. The first radiator section is connected to the first connecting section and extends along the second peripheral edge of the substrate.

The second radiator arm includes a second connecting section, a feed-in section for signal feed-in, a second radiator section, and a third radiator section. The second connecting section is disposed on the first surface of the substrate and is coupled to the ground unit. The feed-in section is disposed on the first surface of the substrate and extends between the second connecting section and the second peripheral edge of the substrate. The feed-in section has a portion that extends parallel to the first radiator section. The second radiator section is connected to the feed-in section and extends along the second peripheral edge of the substrate. The third radiator section is disposed on the first surface of the substrate, is connected to the second radiator section, and extends between the second radiator section and the feed-in section. The third radiator section has a first portion that extends parallel to the second radiator section.

Preferably, the ground unit includes first and second ground parts that are spaced apart from each other. The first ground part is connected to the first connecting section of the first radiator arm. The second ground part is connected to the second connecting section of the second radiator arm.

Preferably, the first connecting section has a first end connected to the first ground part, and a second end opposite to the first end. The first radiator section extends in a direction from the second end of the first connecting section toward the second radiator section and is substantially perpendicular to the first connecting section.

Preferably, the first and second radiation sections are in alignment with each other.

Preferably, the feed-in section has a feed-in portion adjacent to the first connecting section for signal feed-in. The second connecting section interconnects the second ground part and the feed-in portion. The second radiator section has a first end proximate to the first radiator section. The feed-in section is connected to the first end of the second radiator section.

Preferably, the second radiator section further has a second end opposite to the first end. The third radiator section further has a second portion interconnecting the first portion of the third radiator section and the second end of the second radiator section. The first portion of the third radiator section extends in a direction from the second portion of the third radiator section toward the first connecting section.

Preferably, the substrate is formed with a conductive via. The first radiator section is an elongated metal plate, is substantially perpendicular to the first surface of the substrate, and is connected electrically to the first connecting section on the second surface of the substrate through the conductive via of the substrate. The second radiator section is an elongated metal plate and is substantially perpendicular to the first surface of the substrate.

Preferably, the first surface of the substrate is provided with a plurality of solder pads thereon. The first radiator section has opposite first and second ends, each of which is soldered to a corresponding one of the solder pads on the first surface of the substrate. Each of the first and second ends of the second radiator section is soldered to a corresponding one of the solder pads on the first surface of the substrate.

Preferably, the second connecting section of the second radiator arm has a portion extending parallel to the first radiator section of the first radiator arm.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
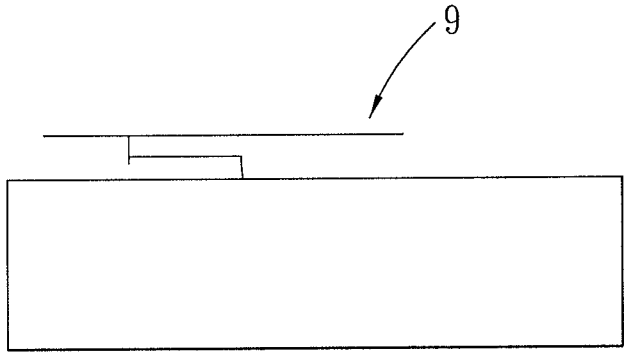
FIG. 1 PRIOR ART
FIG. 1 is a schematic diagram illustrating a conventional planar inverted-F antenna.
Figure 2:
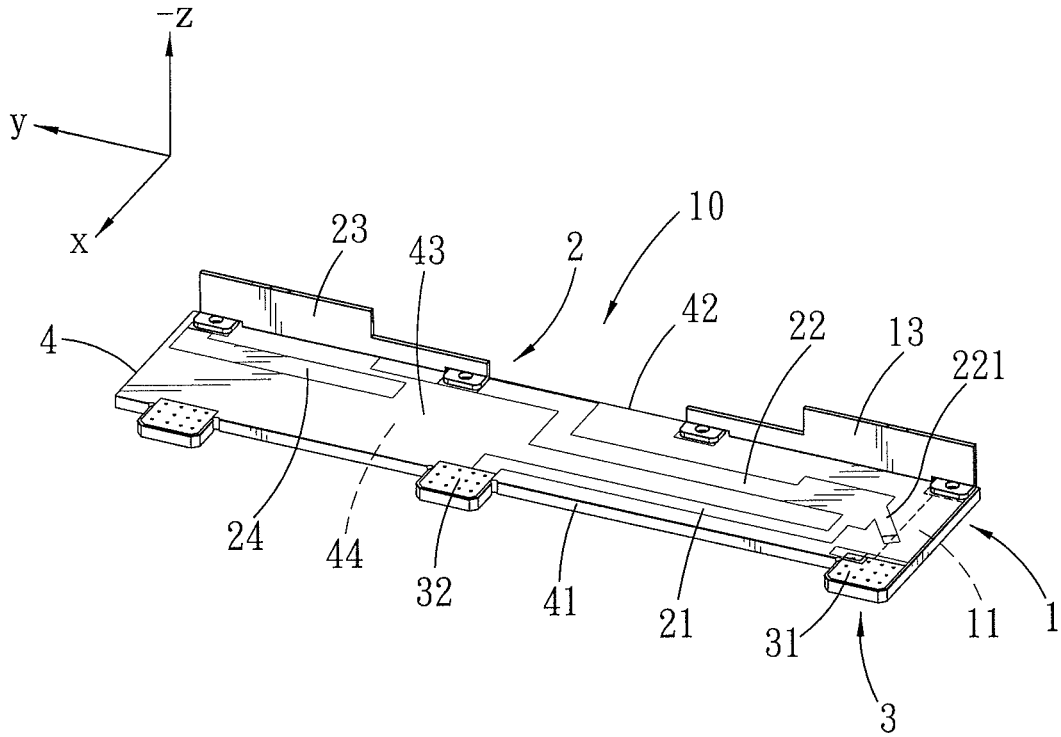
FIG. 2 is a perspective view illustrating an antenna device of the preferred embodiment of the present invention.
Figure 3:
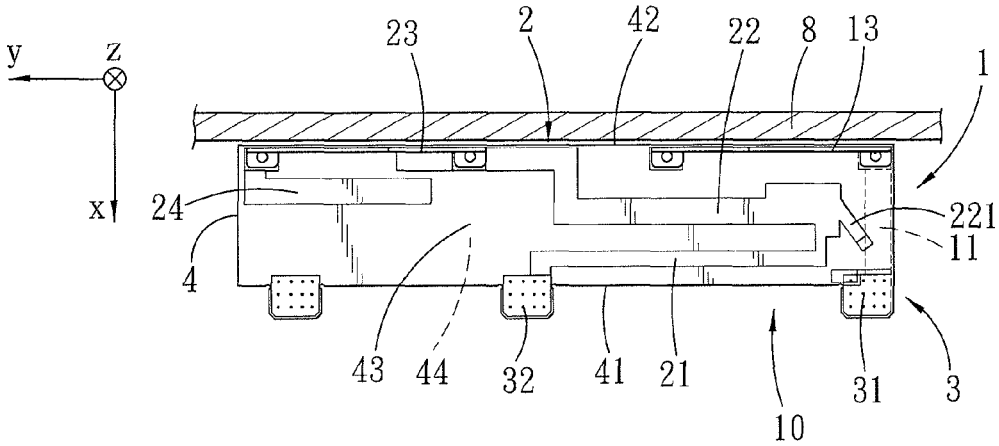
FIG. 3 is a schematic view illustrating the antenna device and a portion of a housing of an electronic device.

Referring to FIGS. 2 and 3, the preferred embodiment of an antenna device 10 according to the present invention is disposed in a housing 8 of an electronic device, and includes a first radiator arm 1, a second radiator arm 2, a ground unit 3, and a substrate 4. The substrate 4 has opposite first and second peripheral edges 41, 42 and opposite first and second surfaces 43, 44. The housing 8 has an inner wall face.

In the present embodiment, the substrate 4 is a rectangular substrate, and is disposed such that the second peripheral edge 42 of the substrate 4 extends along and is adjacent to the inner wall face of the housing 8. However, depending on design requirements, the antenna device 10 can be integrated with a motherboard of the electronic device, or dimensions of the substrate 4 can be changed according to shape of the housing 8.

The ground unit 3 includes first and second ground parts 31, 32, which are spaced apart from each other, disposed at the first peripheral edge 41, and are respectively connected electrically to an electrical ground (not shown) of the electronic device.

The first radiator arm 1 includes a first connecting section 11 and a first radiator section 13.

The first connecting section 11 is disposed on the second surface 44, is coupled to the ground unit 3, extends in a direction from the first ground part 31 toward the second peripheral edge 42 (or the inner wall face of the housing 8), and has opposite first and second ends. The first end of the first connecting section 11 is connected to the first ground part 31.

The first radiator section 13 has a first end connected to the second end of the first connecting section 11, extends parallel to the second peripheral edge 42 in a direction along the y-axis, and is substantially perpendicular to the first connecting section 11. In this embodiment, the first radiator section 13 is an elongated metal plate, is substantially perpendicular to the first surface 43, is disposed proximate to the second peripheral edge 42, is disposed adjacent to the inner wall face of the housing 8, and is connected electrically to the first connecting section 11 on the second surface 44 through a conductive via of the substrate 4. The first radiator section 13 further has a second end opposite to the first end thereof.

The second radiator arm 2 includes a second connecting section 21, a feed-in section 22, a second radiator section 23, and a third radiator section 24.

The feed-in section 22 is disposed on the first surface 43 and has a feed-in portion 221 adjacent to the first connecting section 11 for signal feed-in. The second-connecting section 21 is disposed on the first surface 43, interconnects the second ground part 32 and the feed-in portion 221, and has a portion extending parallel to the first radiator section 13. The second radiator section 23 has a first end proximate to the first radiator section 13. The feed-in section 22 is connected to the first end of the second radiator section 23, extends between the second connecting section 21 and the first end of the second radiator section 23, and has a portion extending parallel to the first radiator arm 13 so as to permit electromagnetic coupling of signals to the first radiator section 13.

The second radiator section 23 extends along the second peripheral edge 42 in a direction away from the first radiator section 13 and in a manner that the first and second radiator sections 13, 23 are in alignment so that the sections 13, 23 are co-linear with each other. In this embodiment, the second radiator section 23 is an elongated metal plate, is substantially perpendicular to the first surface 43, is disposed proximate to the second peripheral edge 42, and is adjacent to the inner wall face of the housing 8. The second radiator section 23 further has a second end opposite to the first end.

It is to be noted that in this embodiment, the first surface 43 is provided with a plurality of solder pads. Each of the first and second ends of each of the first and second radiator sections 13, 23 is soldered to a corresponding one of the solder pads.

The third radiator section 24 is disposed on the first surface 43, is connected to the second radiator section 23, and extends between the second radiator section 23 and the feed-in section 22. The third radiator section 24 has a first portion extending parallel to the second radiator section 23, and a second portion interconnecting the first portion of the third radiator section 24 and the second end of the second radiator section 23. The first portion of the third radiator section extends in a direction from the second portion of the third radiator section 24 toward the first connecting section 11.

Figure 4:
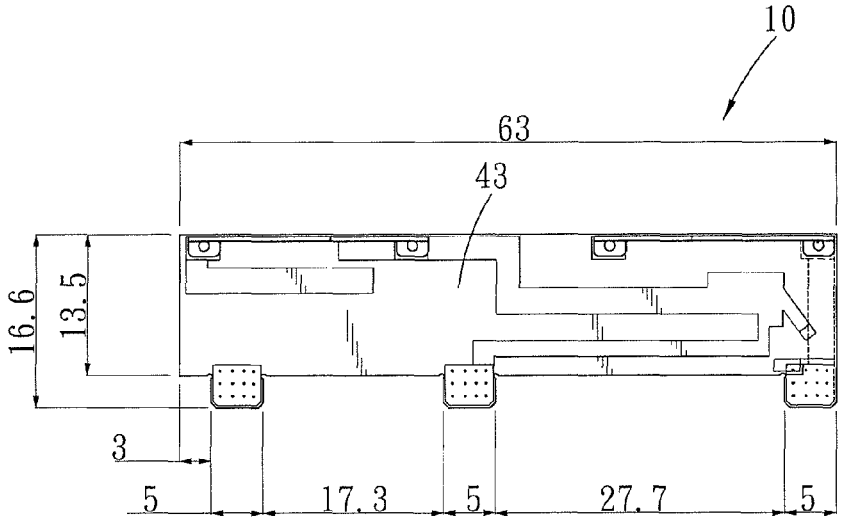
FIG. 4 is a schematic view illustrating dimensions of the antenna device and a dual-band antenna thereof.
Figure 5:
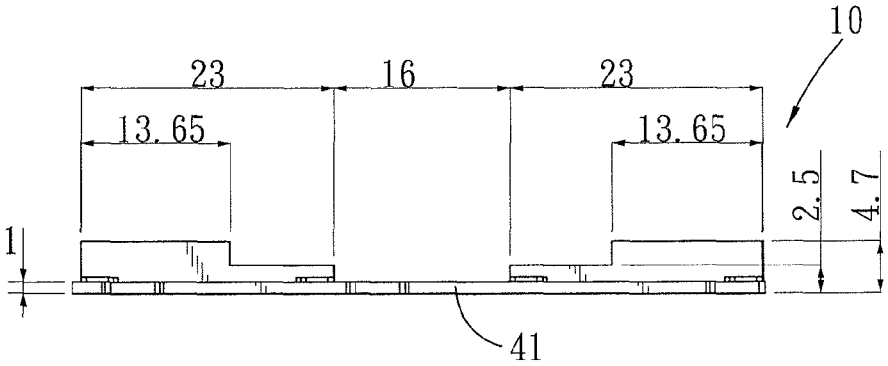
FIG. 5 is similar to FIG. 4, but is viewed from another angle to illustrate thickness of the antenna device.

FIGS. 4 and 5 are schematic views illustrating dimensions of the antenna device 10 in millimeters from different viewing angles.

Figure 6:
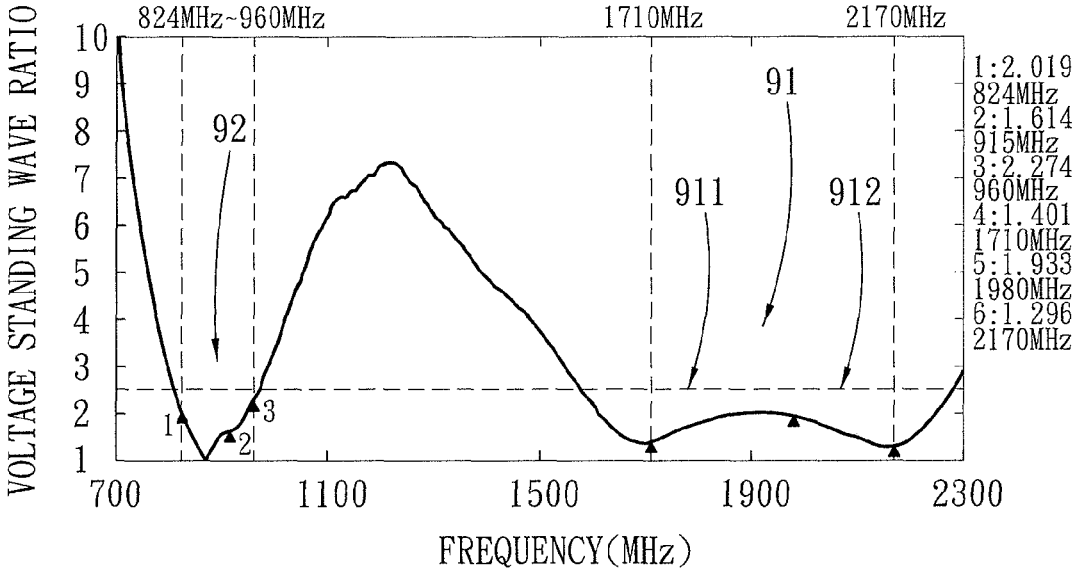
FIG. 6 is a Voltage Standing Wave Ratio (VSWR) plot showing VSWR values of the antenna device within the WWAN frequency range.
Figure 7:
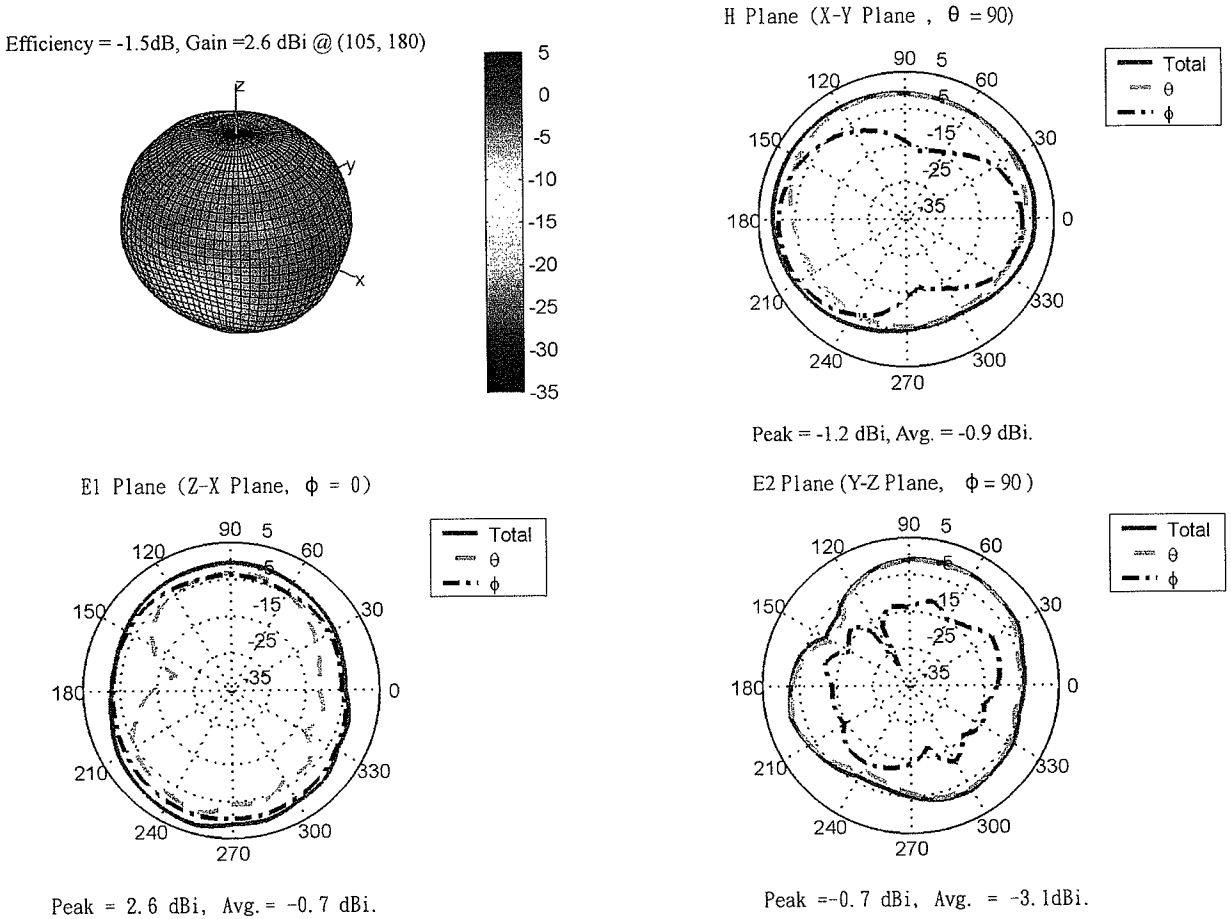
FIG. 7 is a three-dimensional radiation pattern diagram of the antenna device operating at 836.6 MHz, the radiation pattern being further viewed on the X-Y, X-Z, and Y-Z planes.
Figure 8:
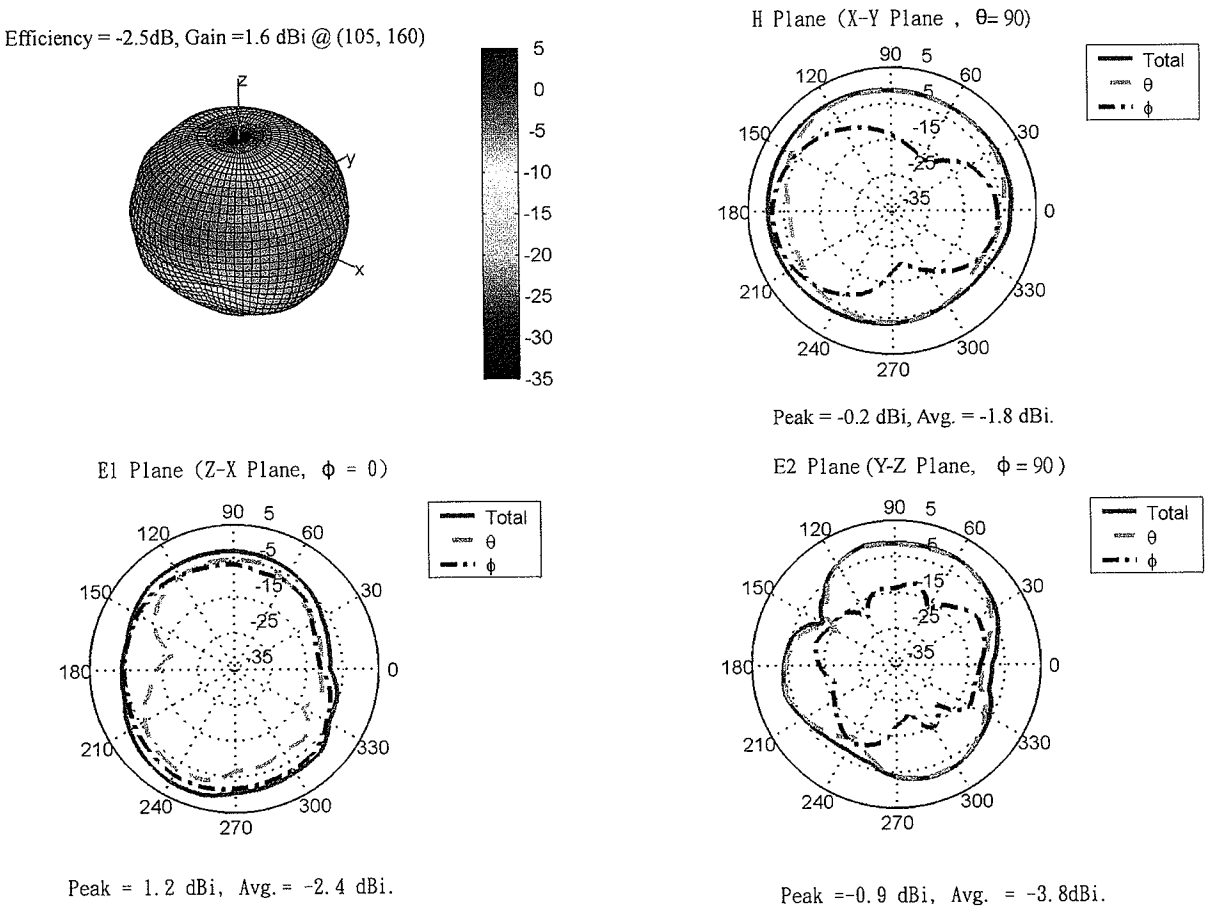
FIG. 8 is a three-dimensional radiation pattern diagram of the antenna device operating at 897.4 MHz, the radiation pattern being further viewed on the X-Y, X-Z, and Y-Z planes.
Figure 9:
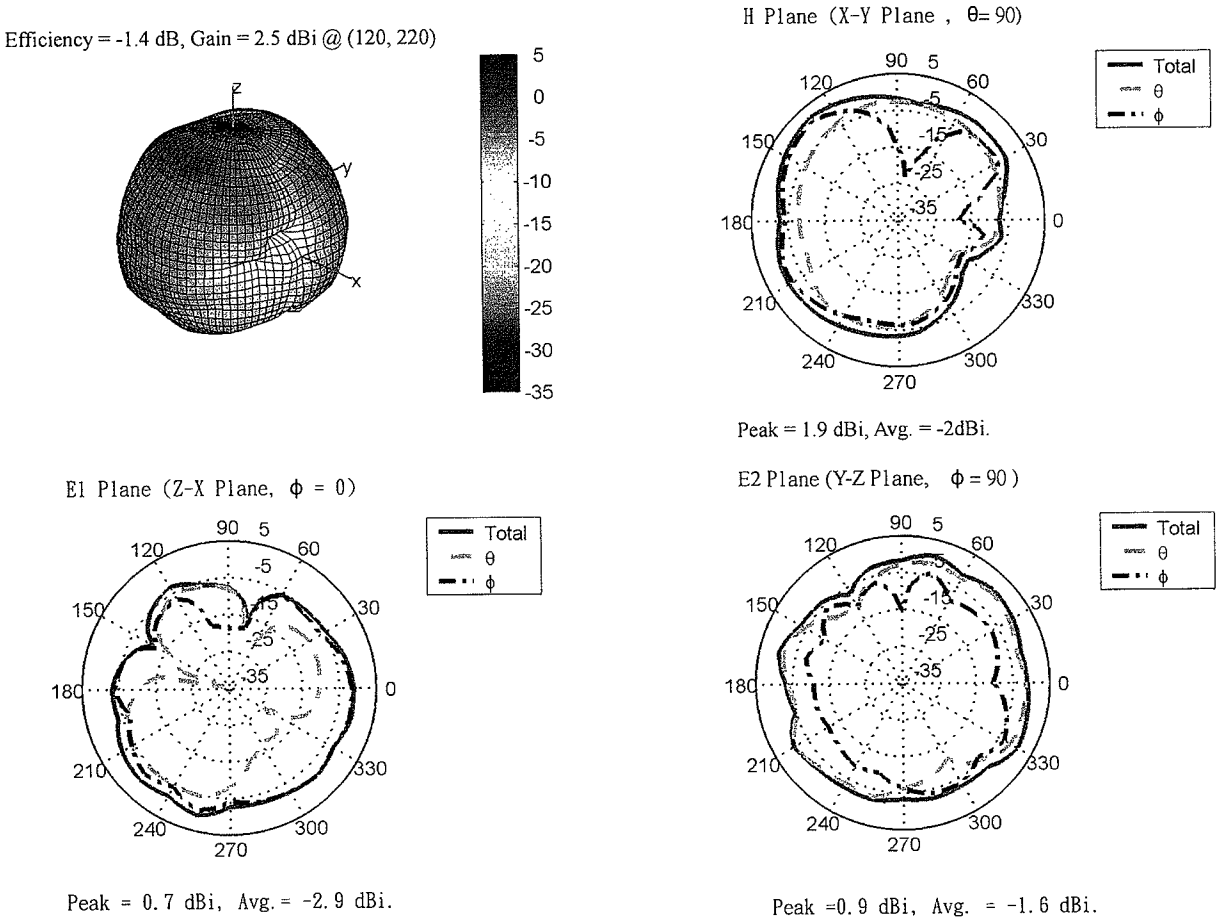
FIG. 9 is a three-dimensional radiation pattern diagram of the antenna device operating at 1747.8 MHz, the radiation pattern being further viewed on the X-Y, X-Z, and Y-Z planes.
Figure 10:
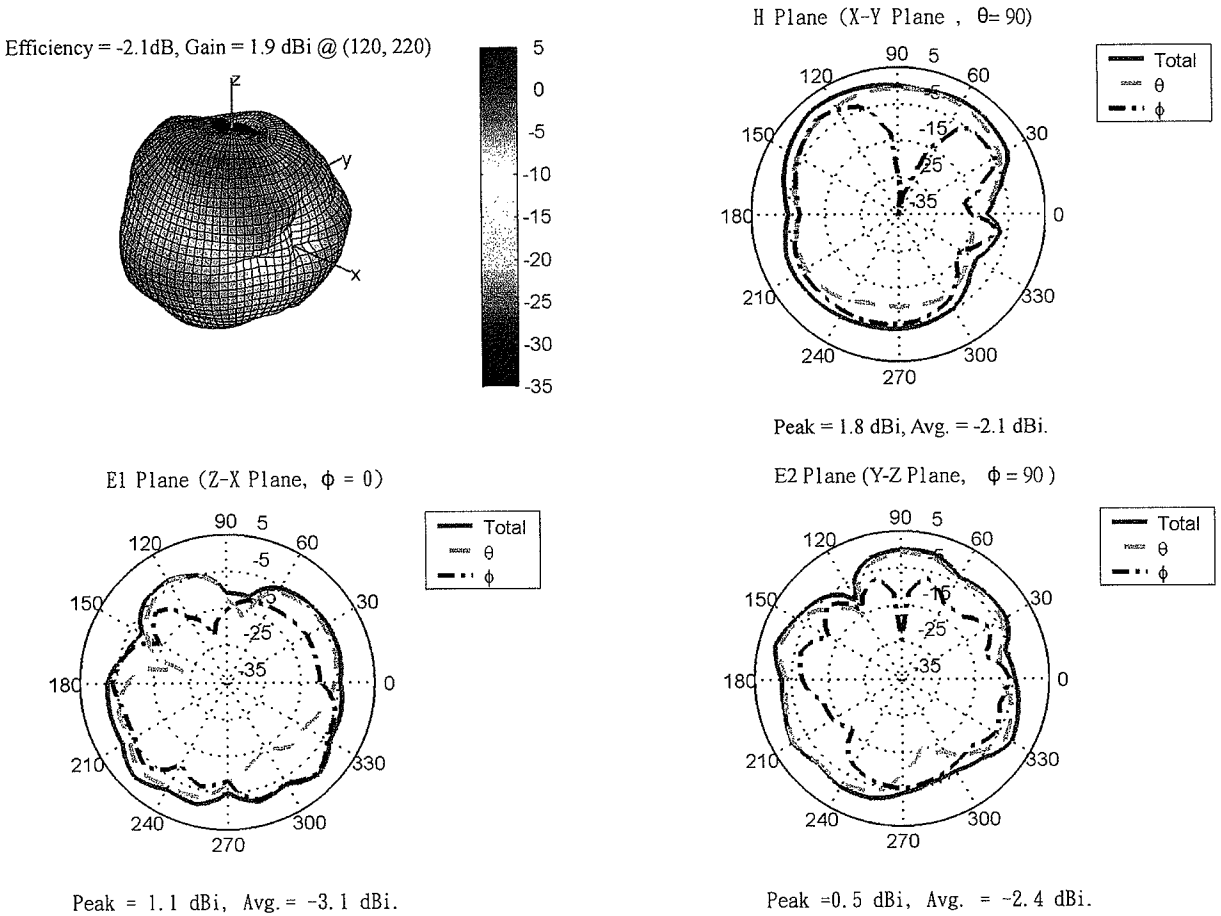
FIG. 10 is a three-dimensional radiation pattern diagram of the antenna device operating at 1880 MHz, the radiation pattern being further viewed on the X-Y, X-Z, and Y-Z planes.
Figure 11:
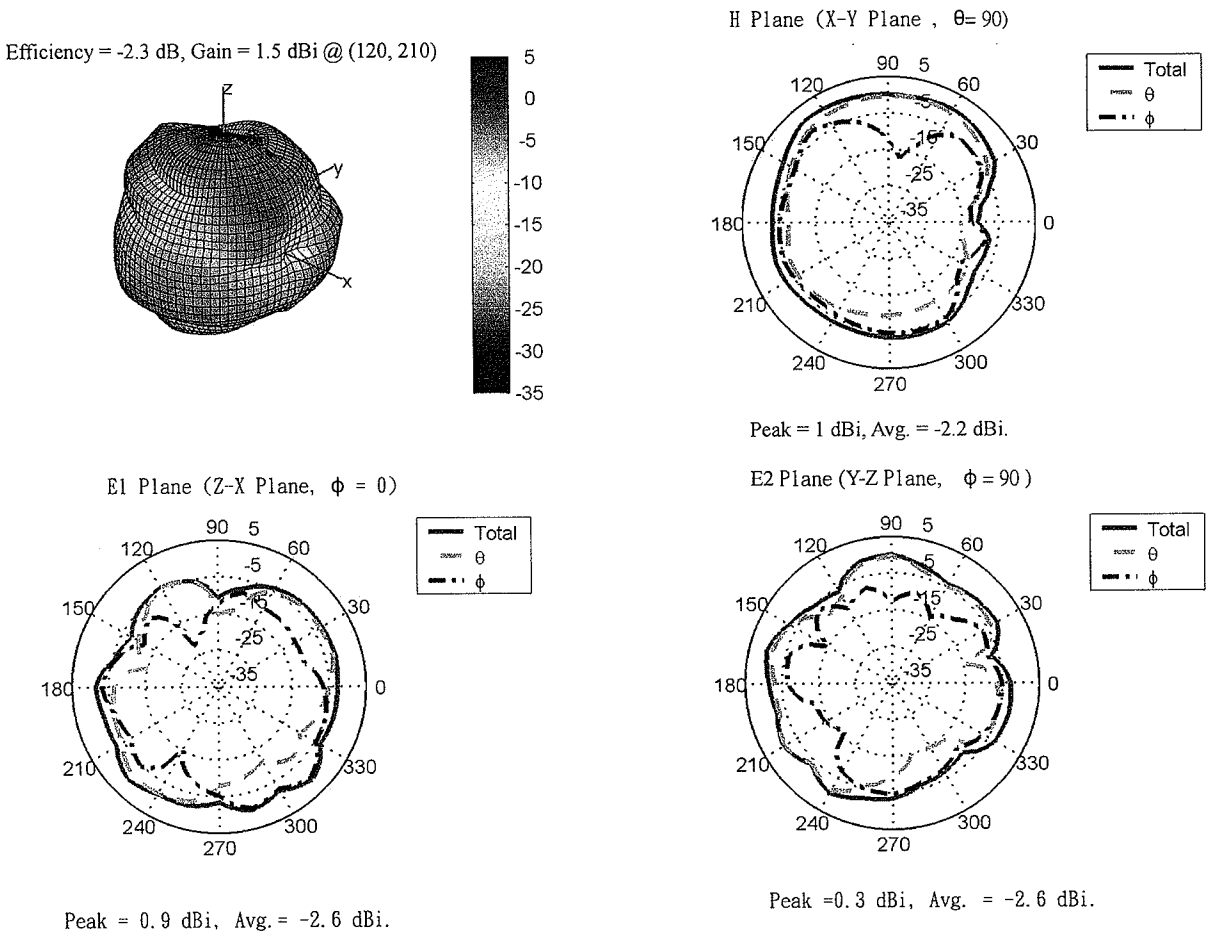
FIG. 11 is a three-dimensional radiation pattern diagram of the antenna device operating at 1950 MHz, the radiation pattern being further viewed on the X-Y, X-Z, and Y-Z planes.

Referring to FIG. 6, the antenna device 10 of this embodiment is adapted to transceive electromagnetic signals at frequencies in a high-frequency resonant band 91 and a low-frequency resonant band 92 of a Wireless Wide Area Network (WWAN), where the high- and low-frequency resonant bands 91, 92 include frequencies ranging from 1710 MHz to 2170 MHz and from 824 MHz to 960 MHz, respectively. The high-frequency resonant band 91 includes a higher sub-band 912 and a lower sub-band 911.

The first radiator arm 1 has a relatively shorter electrical length, and is for transceiving in the lower sub-band 911 of the high-frequency resonant band 91. On the other hand, the second radiator arm 2 has a relatively longer electrical length, and is for transceiving in the low-frequency resonant band 92. It is to be noted that the third radiator section 24 increases an overall electrical length of the second radiator arm 2, which subsequently lowers frequencies of the second-harmonic resonance band of the second radiator arm 2 to those of the higher sub-band 912 of the high-frequency resonant band 91. The second radiator arm 2 is thus capable of transceiving in the higher sub-band 912, and hence the antenna device 10 has a wider bandwidth in the high-frequency resonant band 91 than that of the conventional planar inverted-F antenna 9. Further referring to FIG. 6, the measured VSWR values of the antenna device 10 at frequencies in the high- and low-frequency resonant bands 91, 92 do not exceed 2.5.

FIGS. 7 to 11 show radiation patterns of the antenna device 10 at frequencies of 836.6 MHz, 897.4 MHz, 1747.8 MHz, 1880 MHz, and 1950 MHz, respectively, and different intensities of darkness correspond to different values of gain. Moreover, electrical fields and magnetic fields of the radiation patterns are further presented on the X-Y, Z-X, and Y-Z planes. Gain of the antenna device 10 is measured in dBi (decibel isotropic). In each of the plane diagrams of the radiation patterns, the lighter dashed-line represents the electric field (theta), the darker dashed-line represents the magnetic field (phi), and the solid line represents the total of the electrical field and magnetic field. It can be noted from FIGS. 7 to 11 that radiation patterns of the antenna device 10 are substantially omni-directional.

In summary, the first and second radiator arms 1, 2 of the antenna device 10 are adjacent to the inner wall face of the housing 8 to minimize space requirements of the antenna device 10. The first radiator arm 1 has an electrical length shorter than that of the second radiator arm 2, and is for transceiving in the lower sub-band 911 of the high-frequency resonant band 91. The third radiator section 24 increases the overall electrical length of the second radiator arm 2, and thus lowers frequencies of the second-harmonic resonant band of the second radiator arm 2. Therefore, by virtue of the third radiator section 24, the second radiator arm 2 is capable of transceiving in the low-frequency resonant band 92 and the higher sub-band 912 of the high-frequency resonant band 91.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An antenna device comprising:

a substrate having opposite first and second surfaces, and opposite first and second peripheral edges;

a ground unit for grounding, said ground unit being disposed at said first peripheral edge of said substrate;

a first radiator arm including a first connecting section disposed on said second surface of said substrate, coupled to said ground unit, and extending in a direction from said ground unit toward said second peripheral edge of said substrate, and a first radiator section connected to said first connecting section and extending along said second peripheral edge of said substrate; and a second radiator arm including a second connecting section disposed on said first surface of said substrate and coupled to said ground unit, a feed-in section for signal feed-in, said feed-in section being disposed on said first surface of said substrate and extending between said second connecting section and said second peripheral edge of said substrate, said feed-in section having a portion that extends parallel to said first radiator section, a second radiator section connected to said feed-in section and extending along said second peripheral edge of said substrate, and a third radiator section disposed on said first surface of said substrate, connected to said second radiator section, and extending between said second radiator section and said feed-in section, said third radiator section having a first portion that extends parallel to said second radiator section.

2. The antenna device as claimed in claim 1, wherein said ground unit includes first and second ground parts that are spaced apart from each other, said first ground part being connected to said first connecting section of said first radiator arm, said second ground part being connected to said second connecting section of said second radiator arm.

3. The antenna device as claimed in claim 2, wherein said first connecting section has a first end connected to said first ground part, and a second end opposite to said first end, said first radiator section extending in a direction from said second end of said first connecting section toward said second radiator section and being substantially perpendicular to said first connecting section.

4. The antenna device as claimed in claim 3, wherein said first and second radiator sections are in alignment with each other.

5. The antenna device as claimed in claim 4, wherein said feed-in section has a feed-in portion adjacent to said first connecting section for signal feed-in, said second connecting section interconnecting said second ground part and said feed-in portion, said second radiator section having a first end proximate to said first radiator section, said feed-in section being connected to said first end of said second radiator section.

6. The antenna device as claimed in claim 5, wherein said second radiator section further has a second end opposite to said first end, said third radiator section further having a second portion interconnecting said first portion of said third radiator section and said second end of said second radiator section, said first portion of said third radiator section extending in a direction from said second portion of said third radiator section toward said first connecting section.

7. The antenna device as claimed in claim 6, wherein said substrate is formed with a conductive via, said first radiator section being an elongated metal plate, being substantially perpendicular to said first surface of said substrate, and being connected electrically to said first connecting section on said second surface of said substrate through said conductive via of said substrate, said second radiator section being an elongated metal plate and being substantially perpendicular to said first surface of said substrate.

8. The antenna device as claimed in claim 7, wherein said first surface of said substrate is provided with a plurality of solder pads thereon, said first radiator section having opposite first and second ends, each of which is soldered to a corresponding one of said solder pads on said first surface of said substrate, each of said first and second ends of said second radiator section being soldered to a corresponding one of said solder pads on said first surface of said substrate.

9. The antenna device as claimed in claim 8, wherein said second connecting section of said second radiator arias has a portion extending parallel to said first radiator section of said first radiator arm.

* * * * *